US012070658B2

(12) United States Patent
Fox

(10) Patent No.: US 12,070,658 B2
(45) **Date of Patent: *Aug. 27, 2024**

(54) PICKLEBALL HOLDERS

(71) Applicant: Robert O. Fox, Knoxville, TN (US)

(72) Inventor: Robert O. Fox, Knoxville, TN (US)

( * ) Notice: Subject to any disclaimer, the term of this patent is extended or adjusted under 35 U.S.C. 154(b) by 145 days.

This patent is subject to a terminal disclaimer.

(21) Appl. No.: 17/855,140

(22) Filed: Jun. 30, 2022

(65) Prior Publication Data

US 2023/0293950 A1 Sep. 21, 2023

Related U.S. Application Data

(63) Continuation-in-part of application No. 17/698,281, filed on Mar. 18, 2022, now Pat. No. 11,918,862.

(51) Int. Cl.
*A63B 47/00* (2006.01)
*A41D 13/00* (2006.01)
*A45F 5/02* (2006.01)

(52) U.S. Cl.
CPC ..... *A63B 47/001* (2013.01); *A41D 13/0015* (2013.01); *A41D 2600/10* (2013.01); *A45F 5/021* (2013.01)

(58) Field of Classification Search
CPC ..... A63B 47/00; A63B 47/001; A45F 5/02; A41D 13/0012; A41D 1/08; A41D 1/089
USPC ..... 224/919, 255; D3/257; 211/14; 206/493; 473/21; 2/249; 411/508–510; D8/382, 385; 248/309.2; 24/297; 242/597.3
See application file for complete search history.

(56) References Cited

U.S. PATENT DOCUMENTS 1,851,722 A * 3/1932 Moore ..... A47K 10/3836 242/422.4
2,171,648 A * 9/1939 Ennis ..... A47K 10/3836 411/347
3,136,419 A * 6/1964 Ruderian ..... A63B 47/00 206/315.9
3,143,265 A * 8/1964 Ruderian ..... A63B 57/20 294/142
3,907,287 A * 9/1975 Fox ..... A63B 69/0088 473/424
4,072,256 A * 2/1978 Young ..... A63B 47/001 294/166
4,286,496 A * 9/1981 Harris ..... B25C 1/188 411/908
4,413,762 A * 11/1983 Carini ..... A45F 5/02 206/315.9
4,664,255 A * 5/1987 Griffith ..... B65D 73/0007 206/427
4,767,074 A * 8/1988 Bower ..... A47K 10/3836 242/597.3
5,211,612 A * 5/1993 Carbonero ..... A63B 43/007 473/576
5,323,980 A * 6/1994 Neveu ..... A47K 10/3836 242/597.6

(Continued)

*Primary Examiner* — Justin M Larson
(74) *Attorney, Agent, or Firm* — Luedeka Neely, P.C.

(57) ABSTRACT

Sports apparel having a grommet installed on the sports apparel; and a projection installed on the grommet to extend outwardly from the sports apparel, the projection configured to support a plastic sporting ball by being positioned to penetrate an aperture of the plastic sporting ball for releasably supporting and snugly retaining the apertured plastic sporting ball.

9 Claims, 11 Drawing Sheets

(56) References Cited

U.S. PATENT DOCUMENTS 5,370,339 A * 12/1994 Moody ..... A47K 10/3836 242/599.4
5,813,550 A * 9/1998 Sheehan ..... A47F 5/0807 248/220.31
5,842,938 A * 12/1998 Garber ..... A63B 43/007 473/418
6,033,323 A * 3/2000 McCown ..... A63B 69/0088 473/424
D423,339 S * 4/2000 Snell ..... D6/567
D426,084 S * 6/2000 Kim ..... D6/407
6,997,312 B1 * 2/2006 Reum-Schindler .... B65D 29/04 206/315.9
7,503,528 B2 * 3/2009 Adams ..... F16L 3/137 24/297
7,833,115 B2 * 11/2010 Abel ..... A63B 43/007 473/576
7,950,535 B1 * 5/2011 Schmid ..... A63C 17/0013 211/85.7
8,029,389 B2 * 10/2011 Chiu ..... A63B 69/0002 473/417
8,533,919 B2 * 9/2013 Schliessner ..... F16B 5/0685 24/297
8,707,525 B2 * 4/2014 Davies ..... F16B 5/0628 24/297
8,739,982 B2 * 6/2014 Werner ..... F41A 23/18 211/119.003
9,033,197 B2 * 5/2015 Bar ..... A45F 5/06 224/667
9,089,169 B1 * 7/2015 Covo ..... A41D 1/04
D799,613 S * 10/2017 Dillon ..... D21/713
9,848,579 B2 * 12/2017 Lynch ..... A63B 57/20
10,197,081 B2 * 2/2019 Koelling ..... F16B 12/22
10,226,680 B2 * 3/2019 Simms ..... A63B 43/005
D859,134 S * 9/2019 Iacono ..... D23/262
10,555,572 B2 * 2/2020 Diakonov ..... A41F 9/00
D883,779 S * 5/2020 Koelling ..... F16B 12/22 D8/402
10,814,200 B2 * 10/2020 Scott ..... A63B 43/02
11,076,709 B2 * 8/2021 Gillespie ..... F16B 5/0056
11,278,769 B2 * 3/2022 Houghton ..... A63B 47/02
11,607,030 B1 * 3/2023 Bell ..... A45F 5/02
2011/0077109 A1 * 3/2011 Crowley ..... A63B 69/0002 473/453
2013/0116068 A1 * 5/2013 Traynor ..... A63B 69/0079 473/428
2015/0060623 A1 * 3/2015 Nigro ..... G09F 3/12 248/309.2
2015/0139755 A1 * 5/2015 Lu ..... H05K 7/142 411/510
2015/0209639 A1 * 7/2015 Bishop ..... A63B 69/002 473/424
2020/0298081 A1 * 9/2020 Scott ..... A63B 69/0091
2023/0293950 A1 * 9/2023 Fox ..... A41D 13/0015 2/265
2024/0018953 A1 * 1/2024 Fox ..... F04B 39/12

* cited by examiner

PICKLEBALL HOLDERS

FIELD

This disclosure relates to the field of holders for sporting balls. More particularly, this disclosure relates to holders and apparel configured for holding plastic sporting balls such as pickleballs and whiffle balls.

BACKGROUND

When playing the sport of pickleball, a user typically places one or more extra pickleballs in a pocket. This is inconvenient and often the pickleballs will fall out during play. What is needed is a way to hold more conveniently one or more extra pickleballs. Similar needs may be encountered in the sport of whiffle ball.

What is desired is a device specifically configured for holding apertured and slotted plastic sporting balls such as pickleballs and whiffle balls.

SUMMARY

The above and other needs are met by holders and apparel configured for holding apertured sports balls.

In one aspect, the disclosure provides a ball holder for holding an apertured plastic sporting ball having a plurality of apertures through the sporting balls, the ball holder including an apertured plastic sporting ball having a plurality of apertures through the sporting ball; and an aperture located on a substrate and a projection installed on the aperture to extend outwardly from the substrate. The projection supports the plastic sporting ball by being positioned to penetrate one of the apertures of the plastic sporting ball for releasably supporting and snugly retaining the apertured plastic sporting ball.

In another aspect, the disclosure provides sports apparel configured for holding an apertured plastic sporting ball having a plurality of apertures through the sporting balls.

The sports apparel includes an article of sports apparel; a grommet installed on the sports apparel; and a projection installed on the grommet to extend outwardly from the sports apparel. The projection is configured to support the plastic sporting ball by being positioned to penetrate one of the apertures of the plastic sporting ball for releasably supporting and snugly retaining the apertured plastic sporting ball.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

Figure 5:
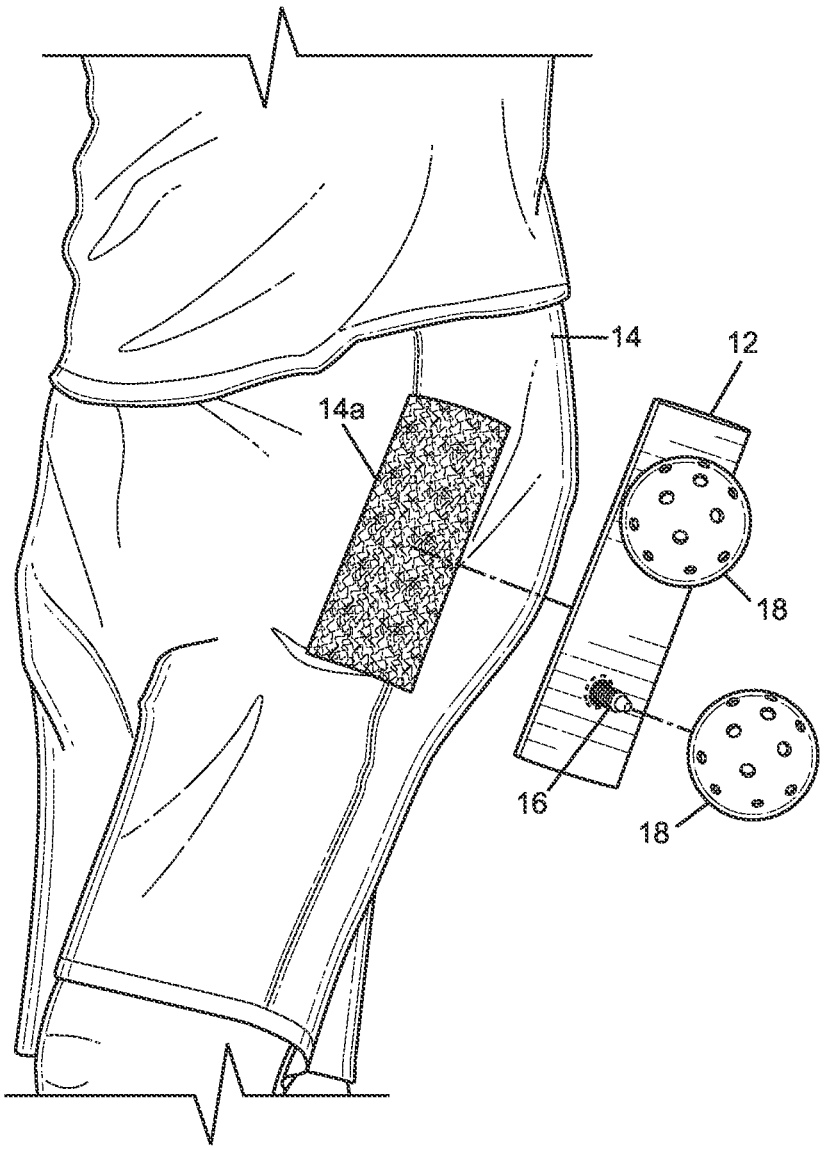
FIG. 5 shows an alternate embodiment of a holder according to the disclosure.
Figure 6:
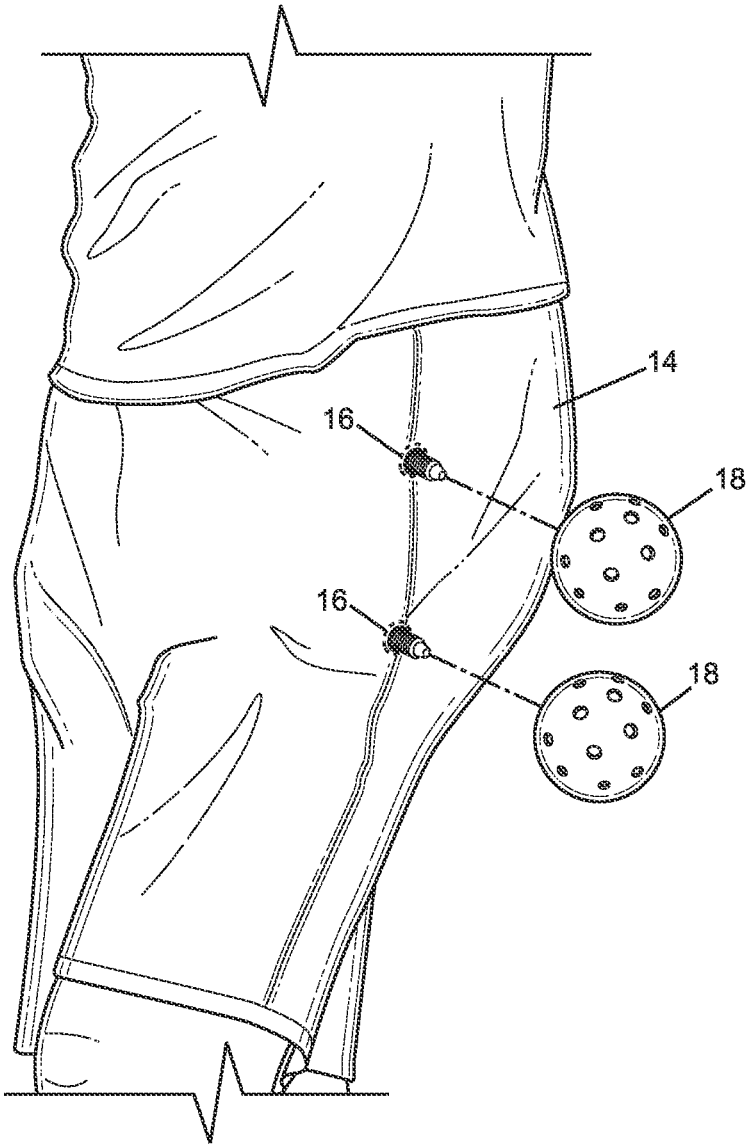
FIG. 6 shows a further embodiment of a holder according to the disclosure.

With initial reference to FIGS. 1-4, there is shown a sports ball holder 10 according to the disclosure. The holder 10 includes a frame 12 configured to slip over and be frictionally retained on an article of apparel, such as over the waist band of a pair of athletic shorts 14 or the like apparel of a pickleball or whiffle ball player. A pair of spaced apart flexible and compressible projections 16 are located on an outward facing surface of the frame 12. The projections 16 are configured to releasably but snugly engage and retain a hard and hollow plastic ball 18, such as a hard plastic pickleball or a hard plastic whiffle ball, having apertures 18*a*. FIGS. 5 and 6 show alternate embodiments of ball holders. The holders described herein are also aesthetically pleasing.

The frame 12 is desirably of thin and lightweight molded plastic, rubber, or the like. The frame 12 is J-shaped and secures onto the waist band of apparel as by a catch 12*a*. The frame 12 may be fairly rigid or may be flexible. The frame 12 may also be of a fabric or other sheet material suitable for supporting the projections 16 for use in holding the balls 18.

The apparel represented by the shorts 14 may alternately be a shirt or other clothing item, or a sports bag or the like substrate or surface, to which the holder 12 is applied.

The projections 16 are configured to releasably but snugly engage one of the apertures 18*a* of the pickleball 18 or other sports ball. The projections 16 are configured to retain the pickleballs 18 thereon until deliberately removed by the player. Two of the projections 16 are shown. The number of projections 16 may be one, two or more as needed to hold a desired number of the balls 18.

The projections 16 are preferably formed of a soft and flexible/compressible polymer such as rubber, silicone, or plastic that is compressible so as to compress/flex for insertion through the apertures 18*a* to frictionally hold the ball 18 on the projection 16. As used herein, the terms flexible and compressible are used interchangeably in connection with the characteristics of the projections 16 to reduce to the size of the aperture 18*a* so as penetrate into and snugly grip the apertures 18*a* to frictionally and snugly retain the ball 18 on the projection 16. A more rigid projection 16 may be used. For example, a plastic more rigid than the plastic of the ball 18. In such case, the plastic of the ball 18 at the aperture 18*a* may slightly flex or compress so as to deform as the projection 16 is inserted to snugly receive the projection 16. However, this is less preferred for use on holders worn on the body of a player but may be better utilized for holders not worn on the body of the player.

The projections 16 may also have ribs or other rugous surface structures that compress to fit into the apertures 18*a* of the ball 18. The projections 16 are sufficiently rigid along their length axis to penetrate into one of the apertures 18*a* of the ball 18 for installation and maintenance of the ball 18 onto the projection 16, but preferred projections 16 to be worn by the player are desirably configured to flex relatively easily under any appreciable force to bend and flex in the event the player falls or the like. Thus, if the projections 16 come into contact with the ground they bend and flex.

FIGS. 2 and 3A-3C depict examples of preferred shapes for the projections 16. It is desirable that the projections 16 are fairly short, with the length of the projections 16 being sufficient so that the free end extends just interior the thickness of the sidewall of the ball 18 but sufficiently deep so that the ball 18 is frictionally and snugly retained on the projection 16 during player movement. Thus, while the user is running, hitting the ball, and the like during play, the ball 18 does not appreciably wobble or move relative to the projection 16 while it is retained thereon.

Figure 1:
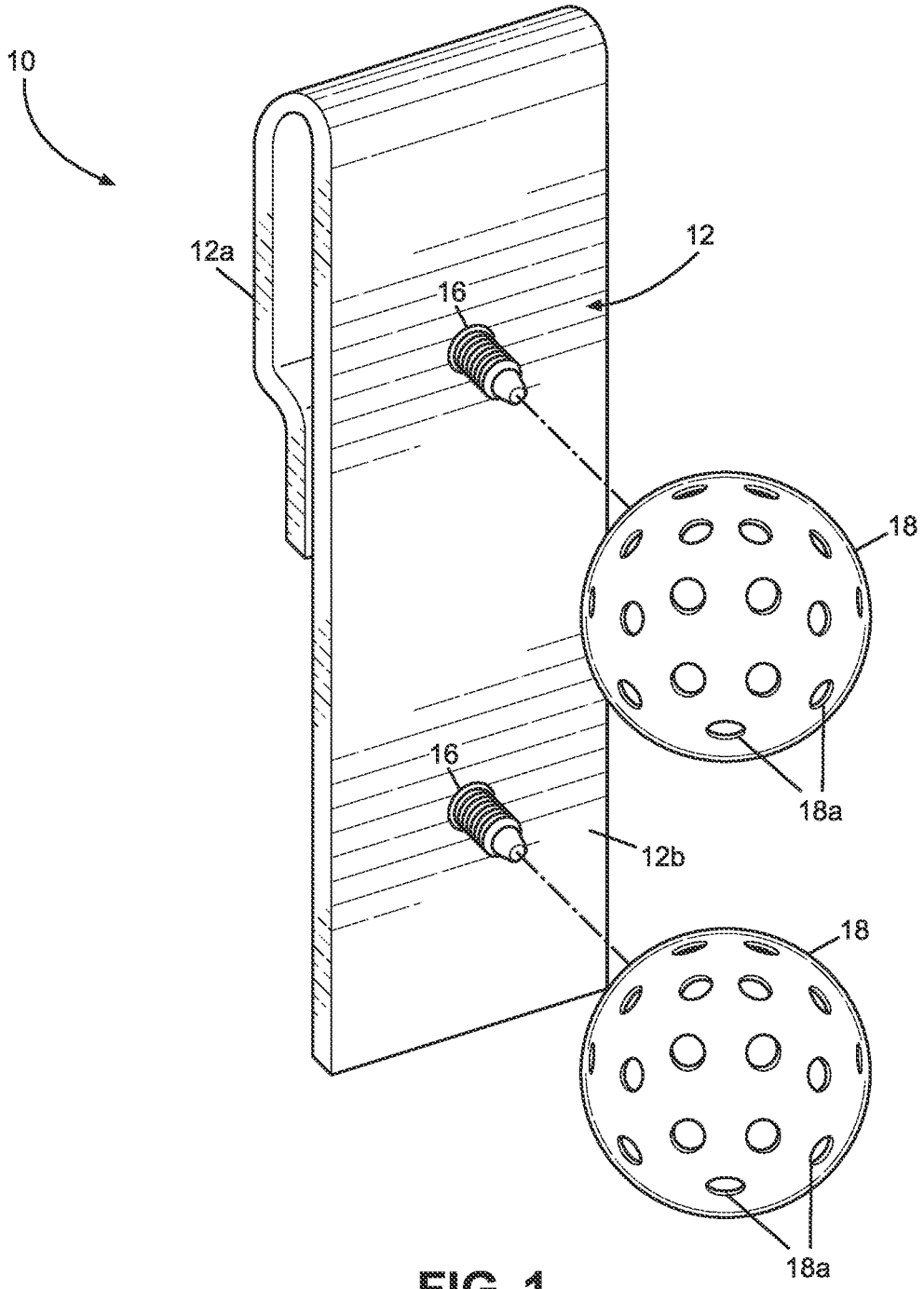
FIG. 1 is a perspective view of a pickleball holder according to one embodiment of the disclosure.
Figure 2:
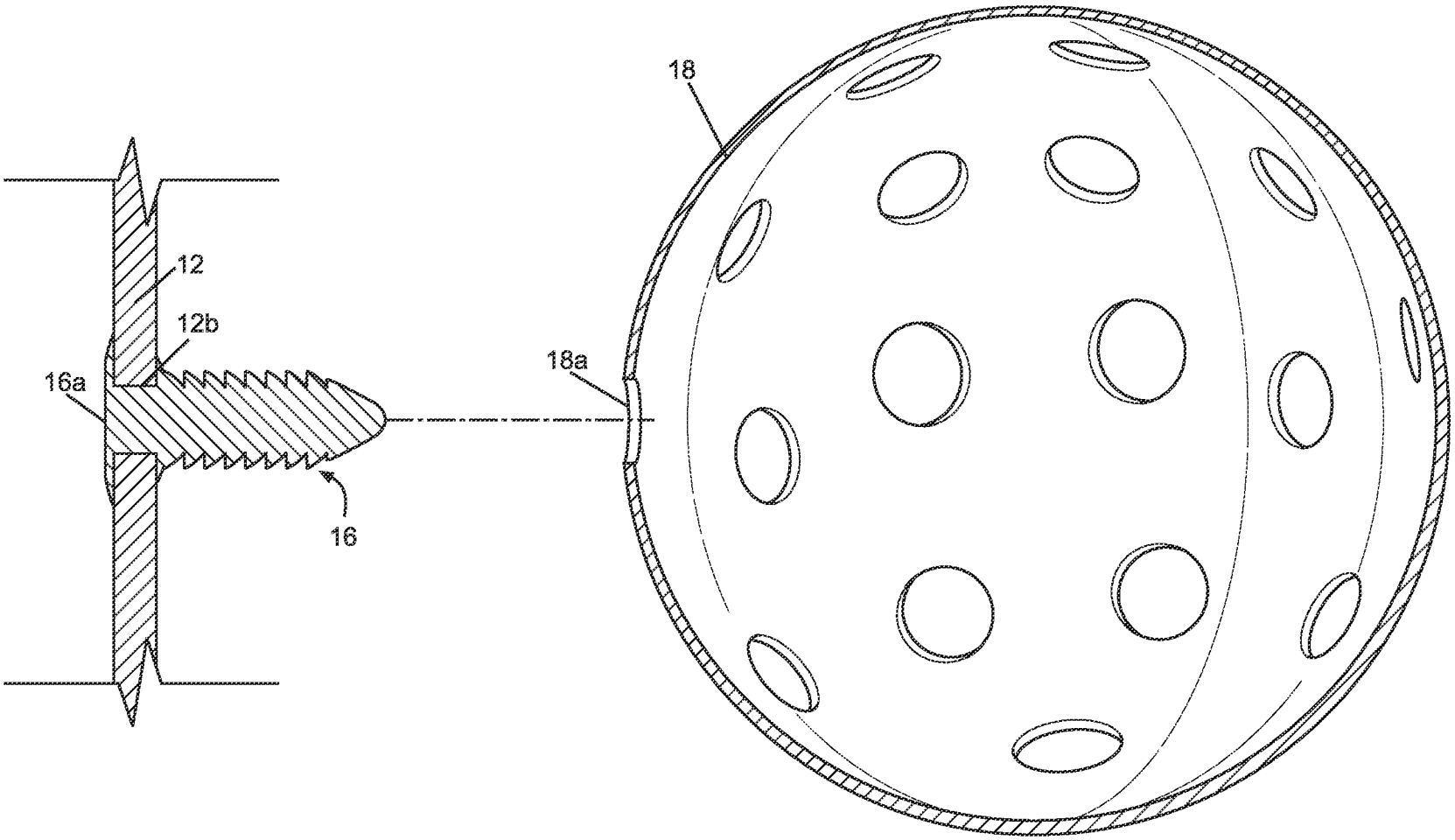
FIG. 2 is a cross-sectional view of a portion of the holder showing installation of a projection thereon.
Figure 3A:
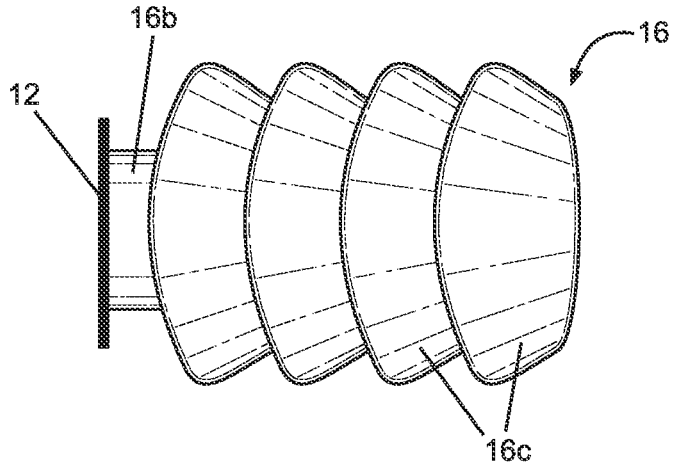
FIGS. 3A-3C show alternate projection structures.
Figure 3B:
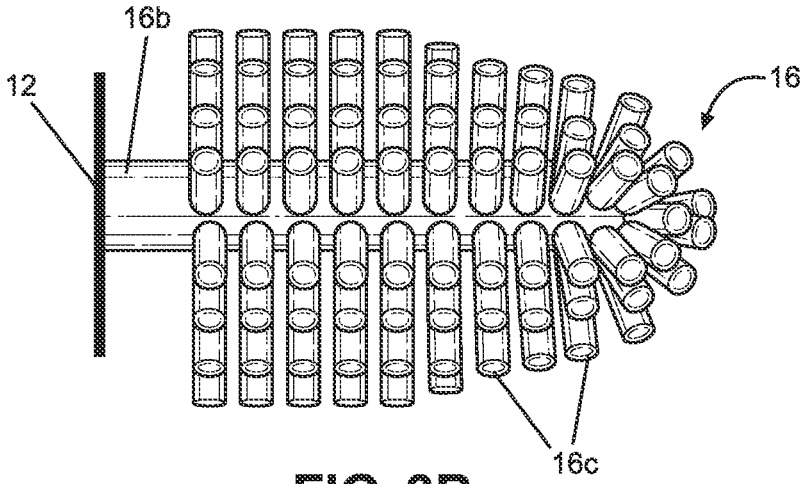
Figure 3C:
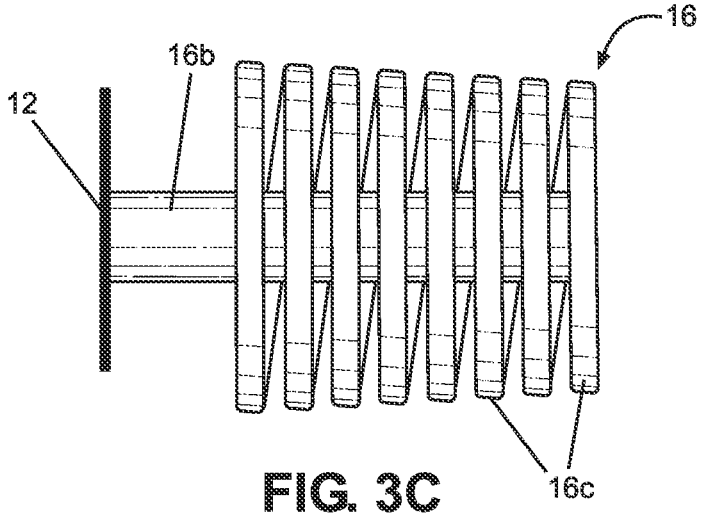

The projections 16 may have a head 16*a* and extend through apertures 12*b* of the frame 12, as shown in FIG. 2. The head 16*a* may be secured to the frame 12 as by friction, adhesive or sonic welding or the like. Alternatively, as shown in FIGS. 3A-3B, the projections 16 may be formed on or with the surface of the frame 12. In either case, the projections 16 are fixed to and extend away from the surface of the frame 12 so as to be positioned to penetrate one of the apertures 18*a*. The projections 16 are shown extending generally perpendicularly away from the exterior surface of the frame 12 but could be oriented at an upward or downward angle. The projections 16 may be co-formed with the frame 12 or added thereto.

The projections 16 are generally configured to have an elongate shank 16*b*. The projections 16 are compressible so as to compress/flex for insertion through the apertures 18*a* to frictionally retain the ball 18 on the projection 16. The projections 16 may be smooth and preferably tapered, but desirably may further include a plurality of relatively uniformly spaced apart radial raised flexible surfaces 16*c* formed along the length of the shank 16*b* to further aid in frictional retention of the ball 18 on the projection 16. The flexible surfaces 16*c* may be provided in the nature of fins, bulbs, nibs, ribs and the like as shown. The flexible surfaces 16*c* flex or compress as the projection 16 penetrates through the aperture 18*a*, and then relax and substantially return to their original shape. This occurs during installation of the ball 18 onto the projection 16 and during removal of the ball 18 from the projection 16. The flexible surfaces 16*c* may be all the same size or of differing size, such as providing the surfaces in a tapered or cone shape as shown on some of the embodiments.

The ball 18 depicted is a pickleball and will be referenced herein as a pickleball in the examples, with it being understood that that the structures described herein are compatible with balls of similar structure, such as whiffle balls. The pickleball 18 is a hollow ball made of plastic having the apertures 18*a*, which are generally circular in configuration for a pickleball. Pickleballs generally have a diameter of between about 2.8 and 2.9 inches with a circumference of between about 9.0 and 9.4 inches and a weight of between about 0.7 and 1.0 ounces. The pickleball 18 typically has 26-40 of the circular apertures 18*a*, with the apertures 18*a* being evenly spaced. Indoor use pickleballs have 26 holes each 8 mm in diameter. Outdoor use pickleballs typically have 40 of the circular apertures 18*a* each slightly larger in diameter, such as 10 mm in diameter.

A whiffle ball is similarly constructed, but slightly smaller with apertures in the nature of oblong holes or slots on one side of the ball, and no holes or slots on the other side of the ball. The projections 16 are preferably configured to work with both indoor and outdoor pickleballs, or they may be specific to each type of pickleball. Similarly, a whiffle ball has slots and the projections 16 engage one of the slots.

Figure 4:
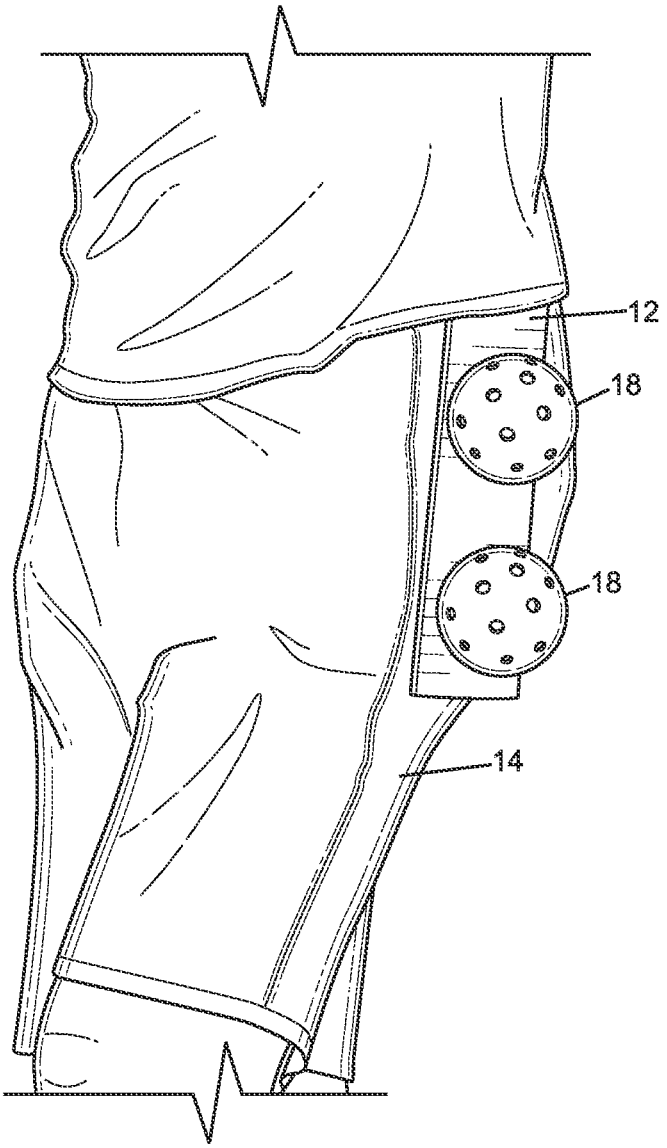
FIG. 4 shows the holder in use.

As shown in FIG. 4, the holder 12 is installed onto the shorts 14 as by clipping the catch 12*a* over the waistband of the shorts 14, preferably alongside of the side of the leg of the shorts where it will be convenient for the player to easily reach and install or remove the balls 18. The holder 12 may be installed on other apparel by use of the catch 12*a*, including apparel in the nature of a shirt or other clothing item, or a sports bag or the like. Likewise, the holder 12 may be secured to a courtside support for holding the balls 18.

With reference to FIG. 5, there is shown an alternate embodiment of the holder 12 configured with the frame 12 not being J-shaped and not including the catch 12*a*. Instead, the shorts 14 include a loop/hook material 14*a* and the holder 12 includes a mating hook/loop material on the backside thereof to releasably mate with the loop/hook material 14*a*. Alternatively, fastening structures other than hook/loop, such as snaps and the like, may be used to releasably or permanently mate the holder 12 to the shorts 14. The holder 12 of this embodiment may also be applied to other support surfaces.

With reference to FIG. 6, there is shown a further embodiment in which the apparel, shown as the shorts 14, include the projections 16 built therein so as to be integrated into the shorts 14. If desired for additional strength, a very thin flexible frame 12 without the catch 12*a* could be utilized and integrated into the shorts 14 to provide support for the projections.

As noted above, the apparel could alternately be a shirt or other clothing item, or a sports bag or the like or other support surface, having the projections built therein in the manner shown on the shorts 14.

Figure 7:
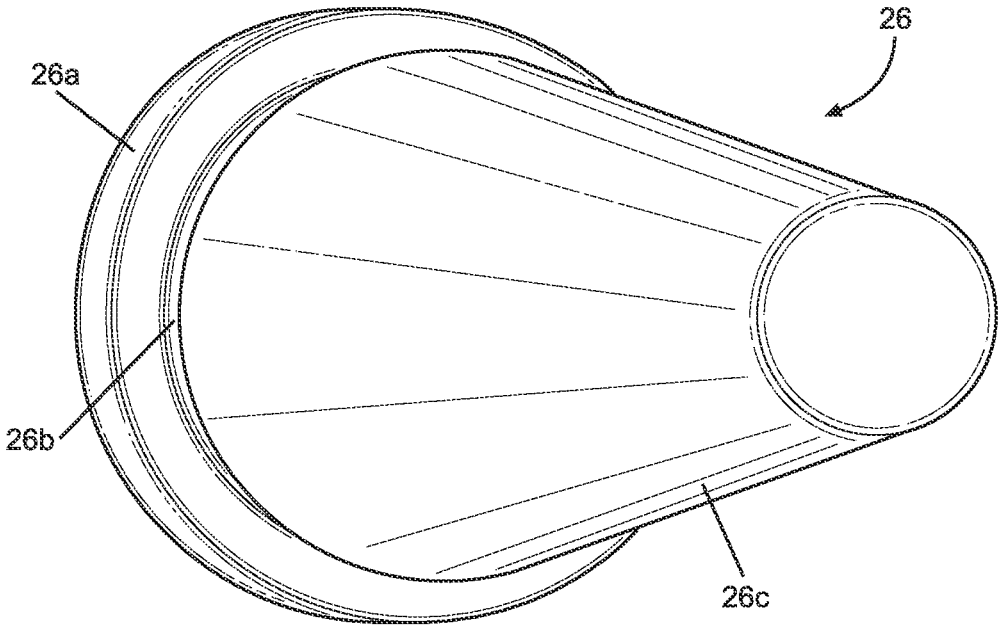
FIGS. 7 and 8 show an alternate embodiment of a projection structure.
Figure 8:
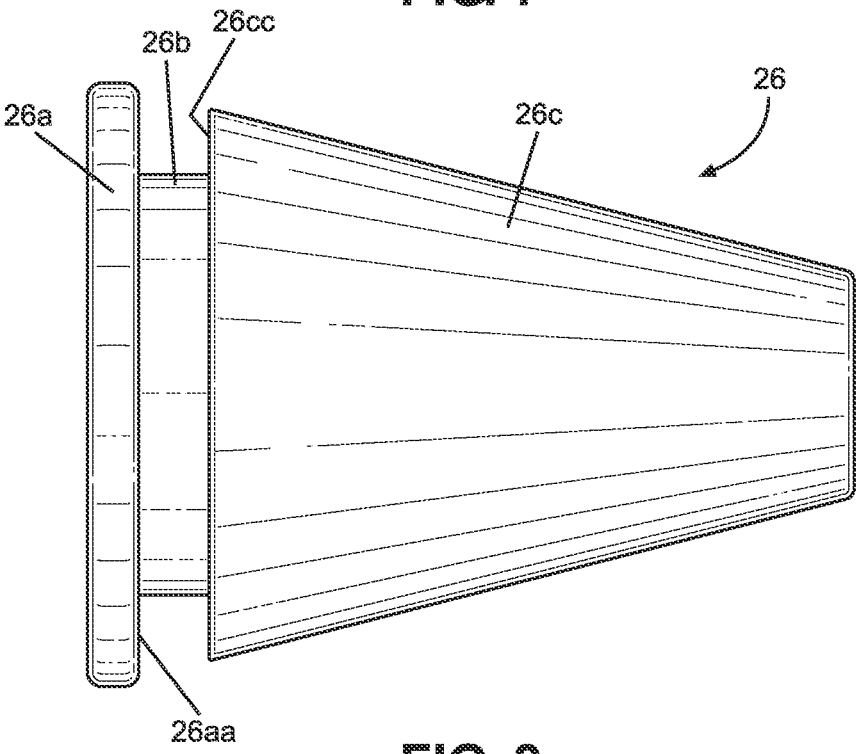

Turning now to FIGS. 7-8, there is shown an alternate embodiment of a projection 26. The projection 26 is configured to readily receive pickleballs 18 having different sized apertures 18*a*. For example, as noted above, outdoor pickleballs generally have apertures 18*a* of about 10 mm in diameter, whereas indoor pickleballs have apertures 18*a* of about 8 mm in diameter. Other pickleballs have a mixture of smaller and larger apertures. Observation of pickleballs 18 from a variety of manufacturers revealed apertures 18*a* that generally range from about 5 mm to about 12 mm in diameter. The projection 26 is configured to receive pickleballs having different sized apertures 18*a* as depicted in FIGS. 9A-9B.

Figure 9A:
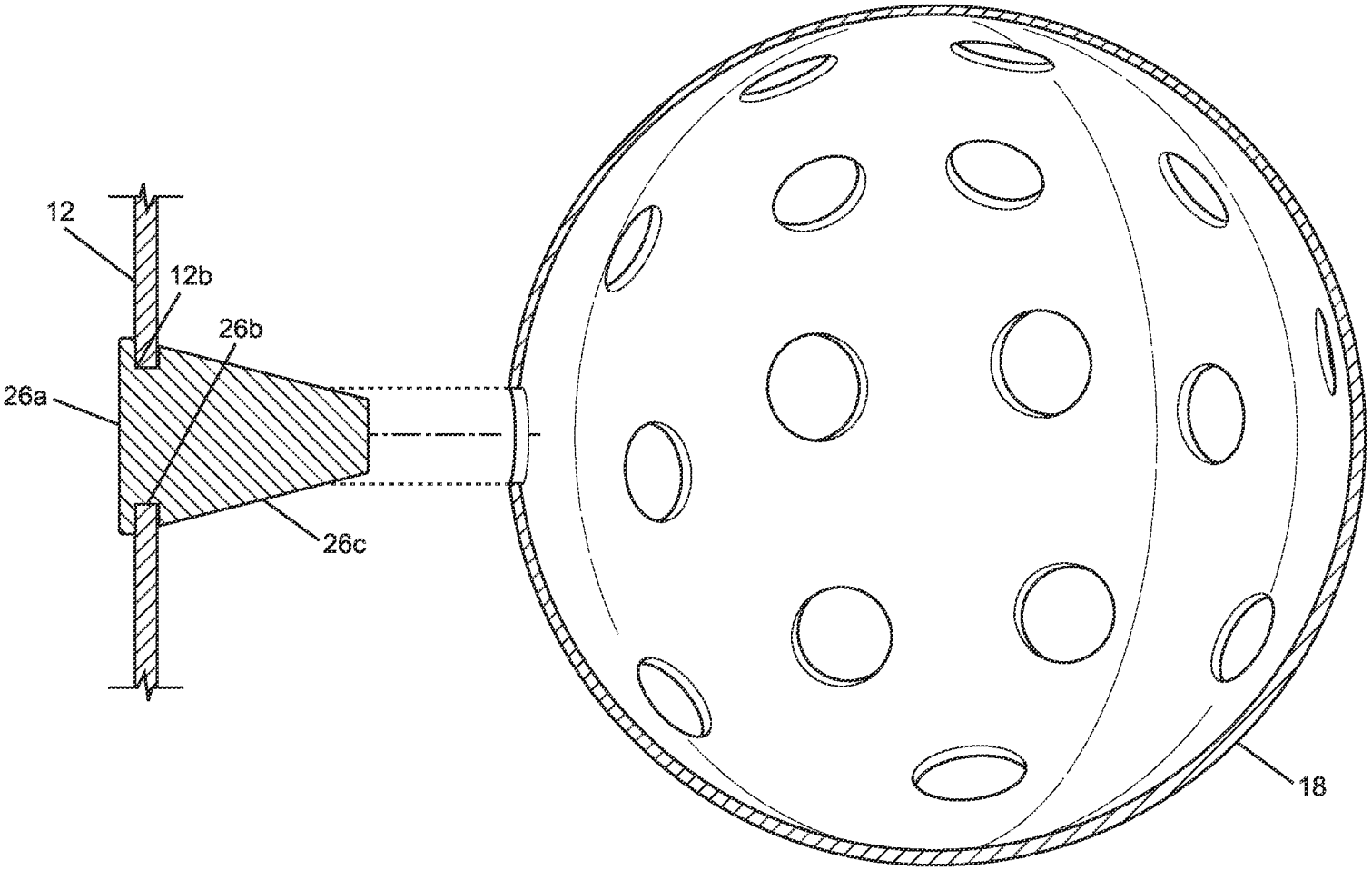
FIGS. 9A-9B depict the projection structure of FIGS. 7 and 8 receiving pickleball apertures of different sizes.
Figure 9B:
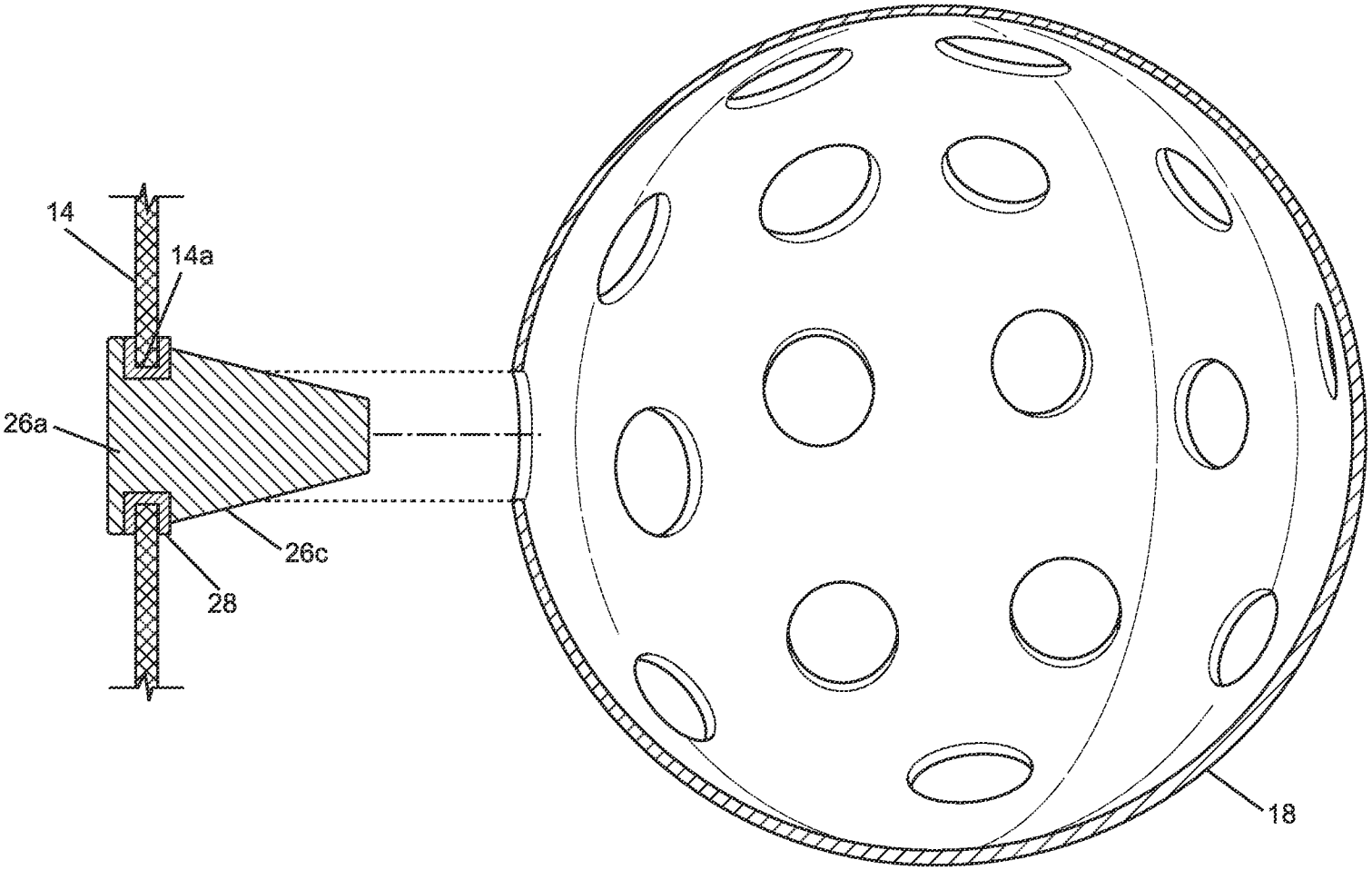

FIGS. 9A and 9B show examples of the locations on the projection 26 where the diameter of the projection 26 matches the size of the aperture 18*a* of the pickleball 18. It will be appreciated that the pickleball 18 is urged onto the projection 26 so that the seated location of the aperture 18*a* is slightly beyond the same size location with the projection 26 compressing at the interface of the aperture 18*a* and the projection 26 so that the ball 18 is frictionally and snugly retained on the projection 26 during player movement. It will be appreciated that the taper of the projection 26 may be selected to fit a variety of aperture ranges.

The projection 26 has an enlarged base 26*a*, an annular mounting groove 26*b*, and an elongate sloped shank 26*c* extending from the groove 26*b* opposite the base 26*a* and decreasing in diameter as it extends away from the groove 26*b*. An interior side of the base 26*a* provides a shoulder 26*aa* on one side of the groove 26*b*. The proximal end of the shank 26*c* is larger in diameter than the diameter of the groove 26*b* to provide another shoulder 26*cc* adjacent the groove 26*b*. The distal end of the shank 26*c* is desirably flat or blunt as shown.

The projections 26 are formed of a soft and flexible/compressible polymer such as rubber, silicone, or plastic that is compressible to compress/flex for insertion through the apertures 18*a* to bear against and frictionally hold the ball 18 on the projection 16. Silicone is particularly preferred. This is preferred for use when worn by a user.

Figure 10A:
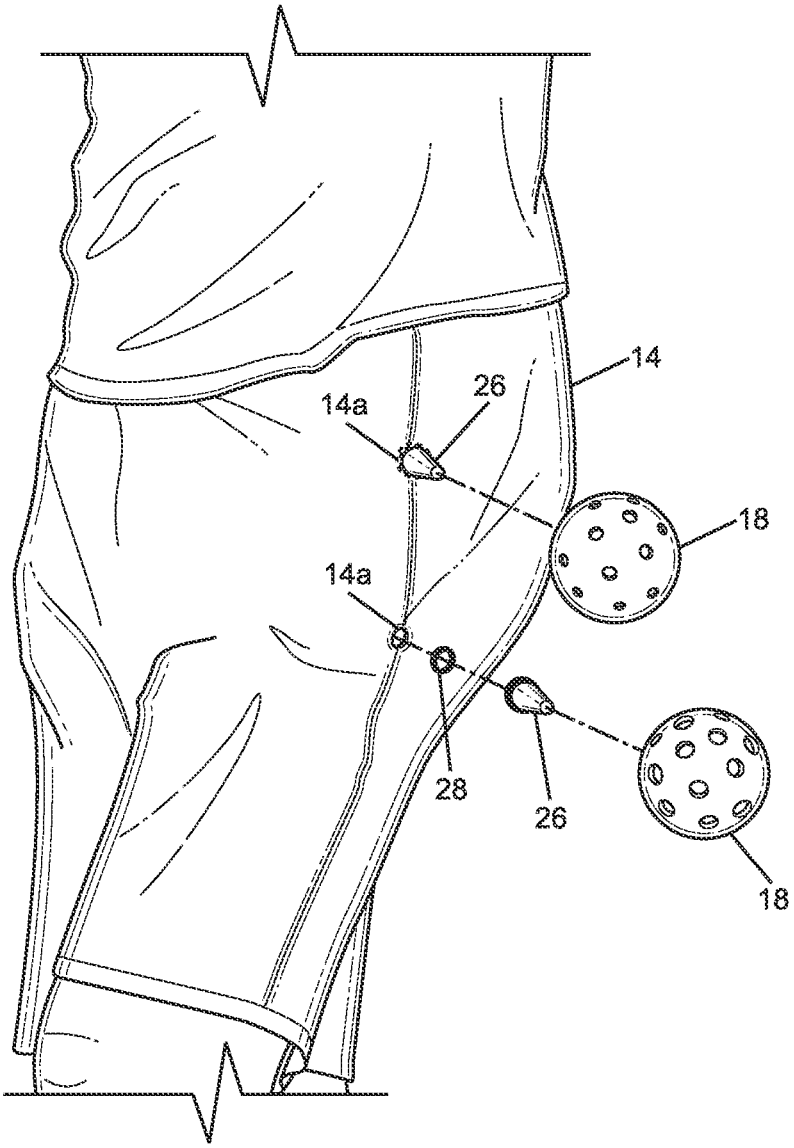
FIG. 10A depicts the projection structure of FIGS. 7 and 8 installed onto a pair of shorts to serve as a holder.
Figure 10B:
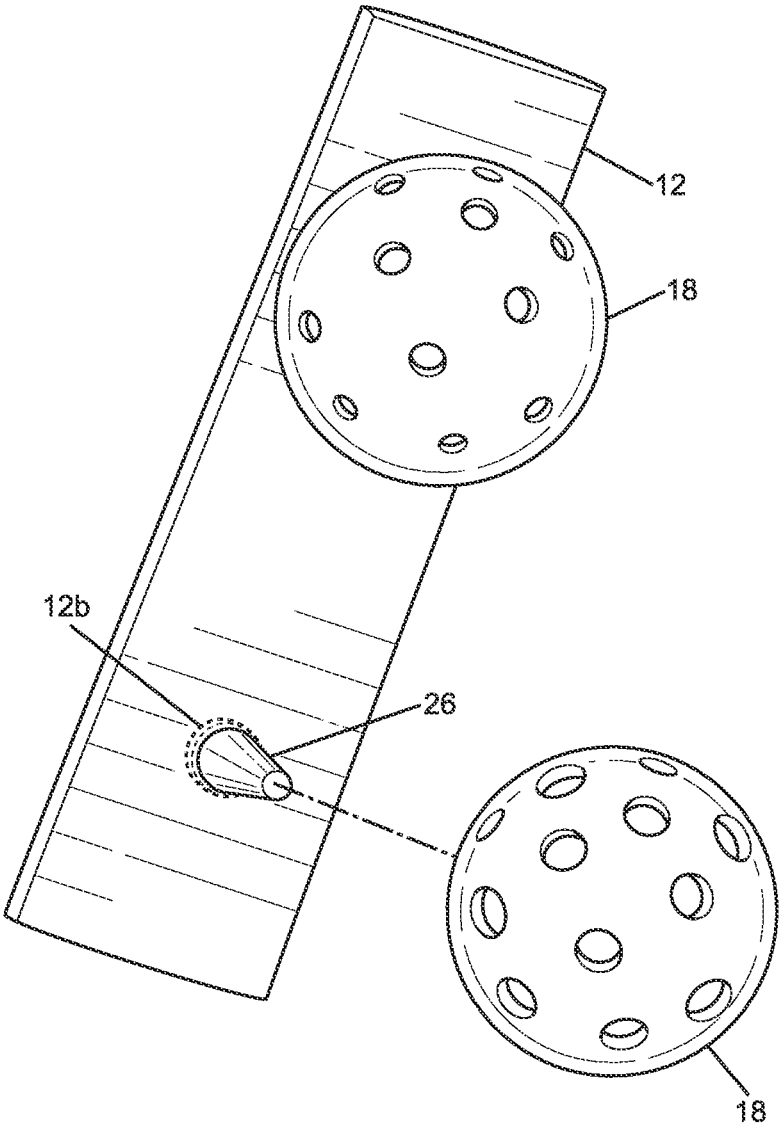
FIG. 10B depicts the projection structure of FIGS. 7 and 8 installed onto a frame.

As seen in FIGS. 9A-9B, the groove 26*b* is received by an aperture, such as the aperture 12*b* of a relatively rigid substrate such as the previously described frames 12 (FIG. 10B). Alternatively, the aperture into which the groove 26*b* is received may be provided as by a grommet 28 (FIG. 10A) applied to provide an aperture through a relatively non-rigid substrate such an aperture 14*a* through the shorts 14.

As noted previously, the apparel represented by the shorts 14 may alternately be a shirt or other clothing item, or a sports bag or the like substrate or surface. In use, if each player in a group of pickleball players wears one of the projections 26, it will be appreciated that sufficient pickleballs are readily available. However, some players may prefer to have two or more pickleballs. As will be appreciated, the projections 26 enable storage by a player of pickleballs in a manner that is much more convenient than storing a pickleball in a pocket.

The compressible/flexible nature of the projection 26 enables quick and secure installation of the projection 26 into the aperture 12*a* or grommet 28. The structure and characteristics of the projection 26 also enable convenient removal or replacement of the projection 26.

For example, as seen in FIG. 10A, one or more of the grommets 28 are installed on the shorts 14. If desired, one or more of the grommets 28 may receive one of the projections 26. However, if it is desired to not install one or more of the projections 26, one or more of the grommets 28 may be left empty.

As the grommet 28 is generally small with a diameter of from about 5 mm to about 8 mm, the empty grommet 28 may be simply decorative and/or provide ventilation in the event it is not carrying one of the projections 26. Thus, a user can use the shorts 14 for pickleball and chose to install one or more of the projections 26, or wear the shorts 14 for other use, such as tennis, and not install the projections 26.

The compressible nature of the projection 26 enables the projection 26 to be easily and snugly installed onto the grommet 28 or aperture 12*a*. In this regard, the groove 26*b* is desirably sized to be slightly larger, such as about 0.5 to about 1 mm larger, than the interior diameter of the aperture 12*a* or grommet 28. In this manner, the groove 26*b* snugly engages the aperture 12*a* or grommet 28.

The base 26*a* is large enough to not be able to easily compress enough to pass through the aperture 12*a* or grommet 28. The sloped shank 26*c* has a proximal end 26*cc* that is larger than the grove 26*b* but smaller than the base 26*a*, and larger than the largest one of the apertures 18*a* to be received by the projection 26. Distal end 26*ccc* of the shank 26*c* is smaller than the smallest one of the apertures 18*a* to be received by the projection 26.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

The invention claimed is:

1. A ball holder, comprising:

an apertured plastic sporting ball having a plurality of ball apertures through the sporting ball, each ball aperture having a diameter;

an aperture located on a substrate and a projection having a shank and installed on the aperture to extend outwardly from the substrate, the shank of the projection having a diameter and supporting the plastic sporting ball by being positioned to penetrate one of the apertures of the plastic sporting ball with the diameter of the shank snugly bearing against and frictionally engaging the diameter of the ball aperture of the one of the apertures for releasably supporting and snugly retaining the apertured plastic sporting ball.

2. The ball holder of claim 1, wherein the projection comprises a flexible projection.

3. The ball holder of claim 1, wherein the aperture comprises a grommet installed on the substrate.

4. The ball holder of claim 1, wherein the projection has an enlarged base, an annular mounting groove having a diameter, and the shank comprises an elongate sloped shank extending from the groove opposite the base and decreasing in diameter as it extends away from the groove, with the groove being received by the aperture.

5. The ball holder of claim 4, wherein an interior side of the base provides a shoulder on one side of the groove and a proximal end of the shank is larger in diameter than the diameter of the groove to provide another shoulder adjacent the groove.

6. The ball holder of claim 5, wherein a distal end of the shank is flat.

7. Sports apparel configured for holding an apertured plastic sporting ball having a plurality of ball apertures through the sporting balls, each ball aperture having a diameter, the sports apparel comprising:

an article of sports apparel;

a grommet installed on the sports apparel; and a projection installed on the grommet to extend outwardly from the sports apparel, the projection having a shank having a diameter and configured to support the plastic sporting ball by being positioned to penetrate one of the ball apertures of the plastic sporting ball with the diameter of the shank snugly bearing against and frictionally engaging the diameter of the ball aperture of the one of the apertures for releasably supporting and snugly retaining the apertured plastic sporting ball.

8. The sports apparel of claim 7, wherein the sports apparel comprises a pair of shorts.

9. A ball holder, comprising:

an apertured plastic sporting ball having a plurality of apertures through the sporting ball;

an aperture located on a substrate and a projection having an enlarged base, an annular mounting groove having a diameter, and an elongate sloped shank extending from the groove opposite the base and decreasing in diameter as it extends away from the groove, with the groove being received by the aperture to install the projection on the aperture to extend outwardly from the substrate at a fixed position and angle, the projection supporting the plastic sporting ball by being positioned to penetrate one of the apertures of the plastic sporting ball for releasably supporting and snugly retaining the apertured plastic sporting ball.

* * * * *